United States Patent [19]

Partington

[11] Patent Number: 4,767,273

[45] Date of Patent: Aug. 30, 1988

[54] APPARATUS AND METHOD FOR REDUCING BLADE FLOP IN STEAM TURBINE

[75] Inventor: Albert J. Partington, Winter Springs, Fla.

[73] Assignee: Westinghouse Electric Corp., Pittsburgh, Pa.

[21] Appl. No.: 18,322

[22] Filed: Feb. 24, 1987

[51] Int. Cl.[4] ..... F01D 5/22

[52] U.S. Cl. ..... 416/191; 416/190; 416/196 R

[58] Field of Search ..... 416/190, 191, 195, 196 R

[56] References Cited

U.S. PATENT DOCUMENTS

| | | | |
|---|---|---|---|
| 2,430,140 | 11/1947 | Phelan et al. | 416/196 R X |
| 3,501,247 | 3/1970 | Tournere | 416/195 X |
| 3,857,650 | 12/1974 | Cerrato | 416/195 X |
| 3,981,615 | 9/1976 | Krol | 416/190 |
| 3,990,813 | 11/1976 | Imai et al. | 416/196 R |
| 4,083,655 | 4/1978 | Tempère | 416/196 R |
| 4,533,298 | 8/1985 | Partington et al. | 416/191 |
| 4,602,412 | 7/1986 | Partington et al. | 20/156.8 B |
| 4,699,569 | 10/1987 | Gloor | 416/191 |
| 4,722,668 | 2/1988 | Novacek | 416/500 X |

FOREIGN PATENT DOCUMENTS

| | | | |
|---|---|---|---|
| 873151 | 6/1971 | Canada | 416/190 |
| 92006 | 8/1978 | Japan | 416/500 |
| 195301 | 10/1985 | Japan | 416/190 |
| 49103 | 3/1986 | Japan | 416/191 |
| 1503453 | 3/1978 | United Kingdom | 416/190 |
| 693041 | 11/1979 | U.S.S.R. | 416/190 |

*Primary Examiner*—Everette A. Powell, Jr.

[57] ABSTRACT

A steam turbine of the type employing axial entry, integral shroud blades has a pin disposed between adjacent shrouds that extends into tangentially oriented holes in the opposing faces of adjacent shrouds. The pins reduce blade flop during turning gear operation and reduce blade vibration during operation under load.

17 Claims, 2 Drawing Sheets

APPARATUS AND METHOD FOR REDUCING BLADE FLOP IN STEAM TURBINE

BACKGROUND OF THE INVENTION

1. Field of the Invention

The present invention is directed generally to steam turbines, and more specifically to steam turbines of the type employing "axial entry, integral shroud" blades. The present invention has particular application to axial entry, integral blades having a generally fir-tree shaped root, but is not limited thereto.

2. Description of the Prior Art

Steam turbines of the type employing "axial entry, integral shroud" blades comprise a rotor having a plurality of generally fir-tree shaped generally axially-extending grooves, with the blades circularly disposed therearound. Each blade has a generally fir-tree shaped root at a proximal end thereof in registration with one of the grooves and a shroud integral with the blade at a distal end thereof. As is known, blade "flop" may occur during turning gear operation of the turbine, i.e. the blade root may rock circumferentially in the groove with which it registers during turning gear operation because the centrifugal force is insufficient to urge the root radially outward. Blade flop may cause root/-groove fretting. Additionally, gaps between adjacent shrouds may open under hot rotor conditions and contribute to blade flop. Moreover, the mating faces of adjacent shrouds may wear from snubbing. Obviously, these are undesirable conditions.

SUMMARY OF THE INVENTION

An apparatus for reducing blade flop comprises a pin disposed between the shrouds of adjacent blades that extends into tangentially oriented holes in the opposing faces of adjacent shrouds. Preferably, the holes extend completely through each shroud and open into each face of the shroud. The pins each have a diameter such that, when installed, there is a friction fit between the periphery of each pin and the walls of the holes into which they extend. The pins are preferably resilient and may comprise self-locking spring pins of the type that are compressible and urge against the walls of the holes when released. The pins prevent relative motion between blades, thus virtually eliminating root/groove fretting caused by blade flop.

A method of assembling a turbine to reduce blade flop comprises the steps of drilling a tangentially oriented hole completely through each shroud and inserting a spring pin through an open end of the hole in each shroud to connect the shrouds of the adjacent blades.

Reference is made to commonly assigned co-pending U.S. patent application Ser. No. 12,778, filed Feb. 9, 1987 for a related but alternate solution to the problem addressed by this invention.

DESCRIPTION OF THE PREFERRED EMBODIMENT

Figure 1:
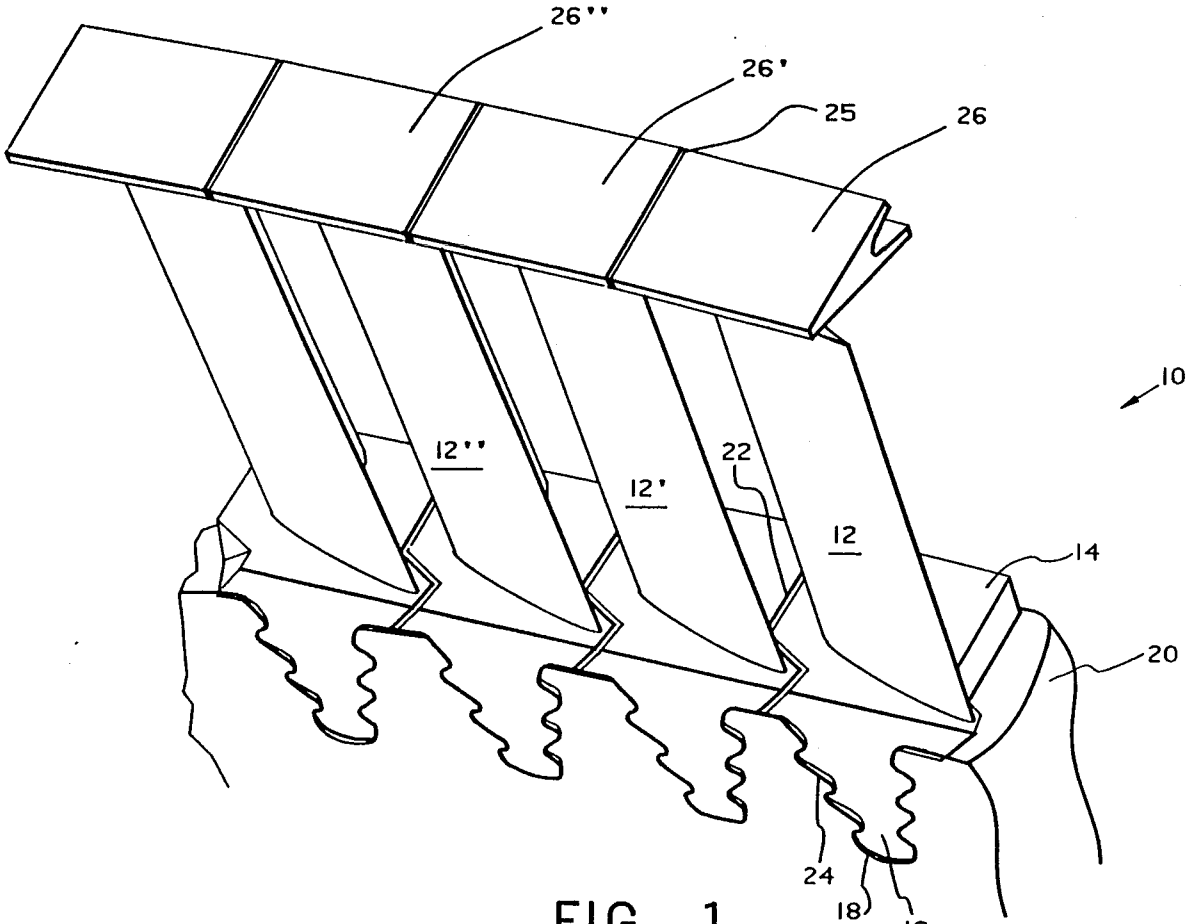
FIG. 1 is a perspective view illustrating a portion of a turbine.

Referring now to the drawings, wherein like numerals represent like elements, there is illustrated in FIG. 1 a portion of a turbine labelled generally 10 and comprising a rotor 20 and a plurality of blades 12. Each blade 12 comprises a platform 14, a root 16 disposed at the proximal end thereof and an integral shroud 26 disposed at the distal end thereof. The rotor 20 comprises a plurality of generally axially-extending grooves 18 disposed therearound. As illustrated, each root 16 and each groove 18 have a generally fir-tree shaped and each root 16 is in registration with one of the grooves 18.

As also illustrated in FIG. 1, there may be a small clearance 22 between adjacent platforms which may open further under hot rotor conditions. Additionally, there may be a small clearance 24 between each blade root 16 and the edges of the groove 18 with which the root 16 registers. Still further, there may be a small clearance 25 between adjacent shrouds 26', 26'' which may also open further under hot rotor conditions. The existence of gaps 22, 24, and 28 may result in blade "flop" during turning gear operation. Still further, the mating faces of adjacent shrouds may wear from snubbing.

Figure 2:
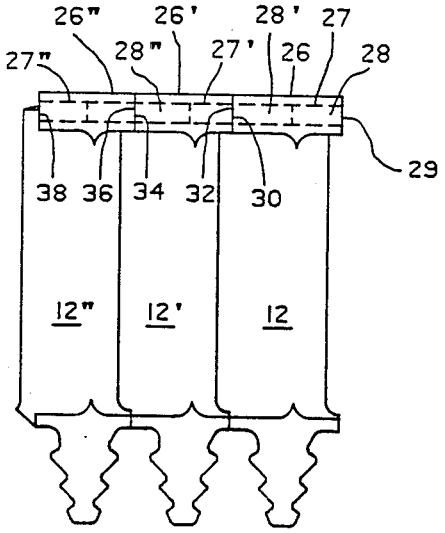
FIG. 2 is a view of a plurality of axial entry, integral shroud blades taken along the axial direction of the rotor and illustrates the pins of the present invention in phantom.

As illustrated in FIG. 2, shroud 26 has a pair of faces 29, 30. Shroud 26' has a pair of faces 32, 34 and shroud 26'' has a pair faces 36, 38. Face 30 of the shroud 26 opposes face 32 of shroud 26'. Similarly, face 34 of shroud 26' opposes face 36 of shroud 26'. Thus, the shroud of each blade has a pair of faces that oppose faces of adjacent shrouds.

As also shown in FIG. 2, there is a generally tangentially oriented hole extending through the shroud of each blade. Thus, a generally tangentially extending hole 27 extends through shroud 26 and opens into faces 29, 30 thereof. Similarly, a hole 27' extends through the adjacent shroud 26' and opens into faces 32, 34 thereof. A hole 27'' extends through the next adjacent shroud 26'' and opens into faces 36, 38 thereof. Thus, the holes extend through each shroud and open into each face thereof.

Figure 4:
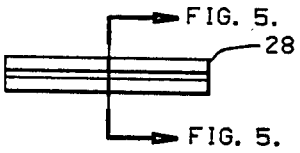
FIG. 4 is a side view of one embodiment of a pin that may be used in the practice of the present invention.
Figure 5:
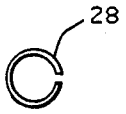
FIG. 5 is a cross-section taken along line 5—5 of FIG. 4.

Disposed between adjacent shrouds is a connector pin as best illustrated in FIG. 2. See also FIG. 3. The connector pin extends between each pair of adjacent shrouds and into the holes of the shrouds. Thus, a pin 28 extends into the hole 27 in shroud 26. The pin 28 also extends into an aligned hole in an adjacent shroud on the right hand side thereof (not shown). Similarly, a pin 28' extends between shrouds 26 and 26'' and is disposed in holes 27, 27'. A pin 28'' is disposed between shrouds 26', 26'' and is disposed in holes 27', 27'', etc. Preferably, the pins each have an outside diameter such that there is a friction fit between the periphery of each pin and the walls of the holes into which they extend. In a preferred practice of the invention, each pin is a self-locking spring pin of the type illustrated in FIGS. 4 and 5. Such a pin may be compressed during insertion and released thereafter so that it urges against the walls of the holes into which it extends. One suitable pin is a Roll-pin manufactured by the ESNA Division of Amerace Corporation, 2330 Vauxhill Road, Union, N.J. A suitable pin is also manufactured by SPS Standard Pressed Steel Co., Jenkintown, Pa.

The present invention is not limited to the use of self-locking spring pins. Any other type of pin, such as a gripspring, taper pin, grooved pin or Spiral-pin may be used. In any event, it is preferred that the pin be resilient and constructed of 12% chrome stainless steel. If desired, the leading edge of each pin may have a chamfered edge to aid in insertion in each shroud.

Figure 3:
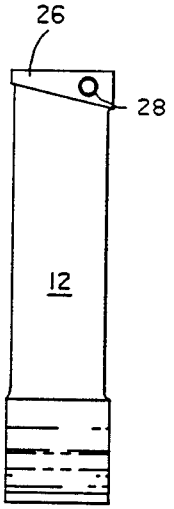
FIG. 3 is a side view of an axial entry, integral shroud blade.

FIG. 3 illustrates the placement of a pin 28 in the hole of a shroud 26, after insertion. Although described herein as an apparatus for reducing blade flop, when pins 28, 28', etc. have been installed as above described, they will also aid to reduce blade vibration during turbine operation.

A method of assembling a turbine to incorporate the above-disclosed apparatus will now be described.

According to the invention, a method of assembling a turbine comprises the steps of drilling a tangentially oriented hole through the face of each shroud, completely through the shroud, then inserting a blade root in one of the grooves in the rotor. Then the root of another blade is inserted in the next groove in succession in the rotor. A pin is then inserted through the open end of a hole in one of the shrouds and pressed therethrough until the pin extends into the hole in the adjacent shroud so that the pin connects both shrouds. For example, with reference to FIG. 2, pin 28' would be inserted in the hole 27 through face 29 and pressed through the shroud 26 until it connects shrouds 26 and 26' as shown. This process is repeated until all blades have been installed in the rotor.

The apparatus and method of the present invention has the following features:

(1) It prevents root/groove fretting.

(2) Shroud tolerance will no longer be critical since the pins will prevent axial motion between shrouds even if there are small gaps.

(3) The pins will reduce relative vibration of the blades during turbine operation under load.

(4) If one of the pins breaks, it will be contained in the hole in which it is disposed and thus will not be thrown out of the turbine due to centrifugal force.

(5) The turbine can be easily disassembled by drilling and/or shearing the pins.

(6) The pins that may be used in the practice of the present invention are standard machine parts and are readily available.

(7) Any steam turbine can be easily retrofitted with the present invention by disassembling each blade row and altering the blades thereof in accordance with the above-described method.

The present invention may be embodied in other specific forms without departing from the spirit or essential attributes thereof and, accordingly, reference should be made to the appended claims, rather than to the foregoing specification, as indicating the scope of the invention.

I claim as my invention:

1. In a steam turbine of a type having a rotor with a plurality of generally axially extending grooves disposed therearound, a plurality of blades, each blade having a root at a proximal end thereof in registration with one of the grooves and a shroud disposed at a distal end, the shroud of each blade having a pair of faces that oppose faces of the shrouds of adjacent blades, an apparatus for reducing relative motion between blades comprising a plurality of pins, each pin being resiliently disposed between adjacent shrouds and extending into tangentially oriented holes in the opposing faces of adjacent shrouds, each hole extending completely through each shroud.

2. Apparatus according to claim 1 wherein each pin has a diameter such that there is a friction fit between the periphery of each pin and the walls of the holes into which it extends.

3. Apparatus according to claim 1 wherein each pin is a self-locking spring pin that urges against the walls of the holes into which it extends.

4. Apparatus according to claim 1 wherein the pin is resilient.

5. Apparatus according to claim 1 wherein the pin has a leading, chamfered edge.

6. Apparatus according to claim 1 wherein the pin is constructed of 12% chrome stainless steel.

7. Apparatus according to claim 1 wherein each groove and each root have a generally fir-tree shape.

8. Apparatus according to claim 1 wherein each shroud is integral with the blade on which it is disposed.

9. Apparatus according to claim 1 wherein the pins reduce blade vibration during turbine operation.

10. Steam turbine comprising:

(a) a rotor having plurality of generally fir-tree shaped, generally axially extending grooves disposed therearound;

(b) a plurality of blades circularly disposed around the rotor, each blade having a generally fir-tree shaped root at a proximal end thereof in registration with one of the grooves and a shroud integral with the blade at a distal end thereof, the shroud of each blade having a pair of faces that oppose faces of the shrouds of adjacent blades, there being a hole extending in the tangential direction through each shroud and opening into each face of the shrouds; and (c) a plurality of pins, there being a pin extending resiliently between each pair of adjacent shrouds and into the holes in the shrouds, each pin having a diameter such that there is a friction fit between the periphery of the pin and the walls of the holes into which it extends, the pins reducing relative motion between adjacent blades.

11. Steam turbine according to claim 10 wherein the pin has a generally C-shaped cross-section and exerts a spring force against walls of the holes.

12. Steam turbine according to claim 10 wherein the pin is resilient.

13. Steam turbine according to claim 10 wherein the pin is constructed of 12% chrome stainless steel.

14. Steam turbine according to claim 10 wherein the pin is a self-locking spring pin.

15. Steam turbine according to claim 10 wherein the pin has a leading, chamfered edge.

16. Steam turbine according to claim 10 wherein the pin reduces blade vibration during turbine operation.

17. In a steam turbine of the type having a plurality of generally fir-tree shaped, generally axially extending grooves disposed therearound, a plurality of blades, each blade having a generally fir-tree shaped root at a proximal end thereof in registration with one of the grooves and a shroud integral with the blade at a distal end thereof, the shroud of each blade having a pair of faces that oppose faces of the shrouds of adjacent blades, a method of assembling the turbine to prevent relative motion between blades comprising the steps of:

(a) drilling a tangentially oriented hole through the face of each shroud completely through the shroud;
(b) providing a plurality of spring pins;
(c) inserting a root in a groove;
(d) inserting a root in the next groove in succession;
(e) inserting a spring pin through the open end of the hole in the shroud of the blade inserted in step (d) until the spring pin extends into the hole in the shroud of the adjacent blade and resiliently connects the shrouds of both blades.
(f) repeating steps (d) and (e) until all blades have been installed in the rotor.

* * * * *